United States Patent [19]

DeWerth et al.

[11] Patent Number: 4,525,141

[45] Date of Patent: Jun. 25, 1985

[54] REGULATION OF BLUE FLAME COMBUSTION EMISSIONS

[75] Inventors: Douglas W. DeWerth, Cleveland; Roger D. Sheridan, Brunswick, both of Ohio

[73] Assignee: Gas Research Institute, Chicago, Ill.

[21] Appl. No.: 512,328

[22] Filed: Jul. 11, 1983

[51] Int. Cl.[3] ..... F23D 13/12

[52] U.S. Cl. ..... 431/347

[58] Field of Search ..... 431/4, 126, 170, 347, 431/350; 122/113, 367 R, 367 C; 110/211

[56] References Cited

U.S. PATENT DOCUMENTS

| | | | |
|---|---|---|---|
| 527,566 | 10/1894 | Wallace | 431/350 |
| 913,567 | 2/1909 | Schirra | 431/347 |
| 1,379,538 | 5/1921 | Silva | 431/347 |
| 1,886,866 | 11/1932 | Blakesley | 431/347 |
| 2,193,176 | 3/1940 | Krugler et al. | 431/350 |
| 2,280,061 | 4/1942 | Cartter et al. | 431/347 |
| 2,745,480 | 5/1956 | Crone | 431/347 |
| 3,105,541 | 10/1963 | Schrader | 431/170 |
| 4,284,402 | 8/1981 | Sheets et al. | 431/347 |
| 4,323,343 | 4/1982 | Reed et al. | 431/350 |

FOREIGN PATENT DOCUMENTS

| | | | |
|---|---|---|---|
| 1522879 | 3/1968 | Italy | 431/347 |
| 185272 | 9/1922 | United Kingdom | 158/113 |

*Primary Examiner*—Samuel Scott
*Assistant Examiner*—Noah Kamen
*Attorney, Agent, or Firm*—Pearne, Gordon, Sessions, McCoy, Granger & Tilberry

[57] ABSTRACT

A flame insert for the reduction of emissions of oxides of nitrogen in atmospheric type burners is disclosed. The insert provides heat radiating surfaces which are contacted by the inner cones of the flames. The insert surfaces are sized and shaped to accommodate variations in flame position and to guide flames into contact therewith. A combined flame insert and secondary air baffling system is also disclosed.

33 Claims, 17 Drawing Figures

REGULATION OF BLUE FLAME COMBUSTION EMISSIONS

BACKGROUND OF THE INVENTION

Prior Art

The present invention relates to the reduction of oxides of nitrogen (NO and $NO_2$) or $NO_x$ emissions in atmospheric type blue flame burners and, more particularly, to the provision and use of a flame insert which is positioned within the flames of the burner to regulate and reduce such emissions. The flame insert is designed to accommodate variations in the burner flames during combustion without loss of effectiveness in reducing $NO_x$ emissions or without reducing appliance efficiency. The flame insert may be combined with a secondary air baffle to achieve acceptable $NO_x$ and CO emission levels.

The atmospheric type burners of concern herein are often incorporated in gas-fired appliances. A gaseous hydrocarbon such as natural gas (methane) or bottled gas (propane) may be used as a fuel gas in such appliances. Examples of such appliances include furnaces, boilers, water heaters, room heaters, space heaters, duct furnaces, commercial cooking equipment, and ranges. Gas-fired appliances are not considered to be major sources of air pollution. However, there are areas within the United States that have very stringent emission regulations, most particularly for $NO_x$ limitations with which gas appliances must comply. Some gas appliances cannot meet these $NO_x$ restrictions.

There are many combustion and/or burner modification techniques which can reduce the $NO_x$ emission of gas-fired burners. These techniques include flue gas recirculation, staged combustion, ultra-high aeration, and burner design or redesign, as well as flame inserts and secondary air baffling, which are of particular interest herein.

Each of the foregoing techniques contemplates manipulating the time, temperature, and reactant concentration during combustion to minimize $NO_x$ formation in a flame. The achievement of the following objectives is considered necessary to lower $NO_x$ emission from a given burner: reduction in peak flame temperature, reduction in time of peak flame duration, increase in NO retention time in the decay temperature region, and reduction in the concentration of reactants in the high-temperature zone.

Various of the foregoing techniques have been applied to both gas-fired industrial burners and, to a lesser extent, residential burners. In substantially all cases, $NO_x$ reduction is possible, though at a cost of complete burner redesign in some cases. The most cost-effective prior art approach known to applicants comprises the use of a metallic screen flame insert to reduce peak temperatures.

The prior art metallic screens are typically fine mesh ($5\times5$, $6\times6$ mesh per inch) and formed of conventional sized wire stock having a diameter in the range of several hundredths of an inch. Such flame inserts are positioned and shaped so that the screen is in as much of the flame as possible and becomes incandescent for purposes of radiating heat away from the flame. Typically, such screens are positioned just downstream from the inner cone of the flame at what is generally considered to be the flame hot spot.

SUMMARY OF THE INVENTION

In accordance with the present invention, a flame insert is provided for use in atmospheric type burners in order to reduce $NO_x$ emissions. The flame insert reduces the peak flame temperatures experienced in the combustion process by radiating heat away from the flames. Accordingly, the reaction kinetics associated with the fixation of atmospheric nitrogen are depressed. The $NO_x$ emission level or factor has been reduced to values of about 40 nanograms/joule useful heat or lower. These reductions in $NO_x$ emissions have been achieved without corresponding undesirable increases in CO emissions. Further, burner efficiency is typically not degraded and, in many cases, consistent increases in recovery efficiency of water heaters have been observed.

The flame insert may include an assembly of insert elements and it is provided with a configuration in accordance with the port arrangement of the burner. The flame insert includes flame guiding and cooling portions comprising at least one insert surface for contacting the array of the flames of the burner when the array assumes its normal combustion position in accordance with the flame directions of the individual flames or flamelets under the influence of their natural buoyancy during combustion. Preferably, the insert surface is located adjacent the inner cone of the flame to rapidly increase the temperature of the insert and decrease the peak flame temperature by radiating heat energy as the insert glows red hot. The flames extend along and freely pass over the insert surface during combustion, and the desired combustion reactions are not affected by disruption of the flames.

The insert surface is arranged and constructed to maintain contact with the flames throughout a predetermined range of position variation of the flames from the normal combustion position. The insert surface is sized and shaped to accommodate variations in both the flame height and the flame alignment with the flame direction. Accordingly, the insert surface tends to remain in contact with the inner cone of the flame regardless of variations from the normal combustion position.

The variation in the flame position may be caused by ordinary transient deviations of the flame during combustion, changes in the fuel gas composition or supply pressure, improper adjustment of the burner, draft changes or dirt accumulation over a period of time, as well as combinations of these items. The American National Standards requirements relating to appliance operation over a range of gas line pressure variations or fuel inputs below and above normal conditions reflect, to a degree, the foregoing potential variations in flame position. The flame insert of the present invention provides the desired $NO_x$ regulation upon operation of the appliance over the specified range of gas line pressure variations.

As indicated above, the flame insert and the insert surface are configured to guide the flame into contact therewith and to provide thereby a corrective positioning function in response to flame variations. An insert surface or two such surfaces may cooperate to partially peripherally confine the flame while otherwise allowing the flames to extend freely along such surface or surfaces in the flame direction. The partial peripheral confinement may restrict upward and downward or lateral side-to-side variations in the flame position. To that end, the insert surface or surfaces effectively provide a channel for maintaining the flames in contact therewith for purposes of radiant cooling and reduction of the peak flame temperature. The flame insert through such partial confinement and/or a draft-type chimney effect has been observed to guide the flames to a selected position and thereafter maintain the flames in such position. The selected position may or may not correspond with the normal combustion position, but it generally does for purposes of the present invention.

In accordance with the present invention, the flame insert or insert element and the insert surface are of substantial dimension as compared to prior art metallic screen inserts. The insert surface is of a size equal to about $\frac{1}{4}$ to $\frac{1}{3}$ of the height of the inner cone of the flame and comparable to its anticipated variation of position. For example, cylindrical insert elements having a diameter in the order of $\frac{1}{4}$ of an inch to $\frac{1}{2}$ of an inch have been found to effectively reduce $NO_x$ emissions and accommodate flame variations. The relatively larger dimensions have also enabled insert structures which are are substantially free of heat distortion. The insert or insert elements may be of solid or hollow cross section, or they may comprise a tubular member with a solid core insert.

The flame insert, insert element or the insert surfaces may be of a nonmetallic or a metallic material, or a combination of such materials. For example, ceramic materials including alumina, mullite, and cordierite have been found acceptable and corrosion-resistant metal such as stainless steel have also been found acceptable.

In contrast with the flame inserts of the present invention, the prior art metallic screens do not contemplate individual elements or flame contacting surfaces of a dimension comparable with that of the inner cone of the flame. Illustrative prior art screens are of wire gauge size materials having diameters in the range of about 0.04 of an inch. Such metallic screens have not been found to accommodate ordinary transient flame deviations. The metallic screens tend to heat-distort, and may be destroyed in part by the oxidizing and reducing properties of natural gas flames, or both, with the result that the $NO_x$ reducing effect is diminished and/or the CO emission is increased due to the misposition in the flame as well as the potential screen destruction.

The metallic screens of the prior art have also been found to disrupt the flames, since the flames do not pass freely through the screen openings. This will reduce the incandescence of the screen and decrease its ability to radiate heat energy away from the flame so as to reduce peak flame temperatures. Further, excessive flame disruption by the metallic screens may, in some cases, interfere with the completion of normal combustion reactions.

A further disadvantage of prior art metallic screens is that when they are placed too near burner ports, or if they warp into the flame inner cone flame bases may jump from the burner ports to the screen openings. This will increase the $NO_x$ emissions and significantly increase the CO emissions.

The flame inserts of the present invention provide a cost advantage over other of the prior art emission reduction techniques and they are characterized by a simplicity of structure and an ease of application which facilitates burner-insert (and possible secondary air baffles) assembly during original manufacture. The dimensioning of the insert surface to accommodate flame variation also reduces the required accuracy of insert position during manufacture. Further, the operating characteristics of the insert and its optional use with secondary air baffling allow ready application to most burner designs. These characteristics also allow retrofit to existing burners, including special application and/or custom fabricated burners.

BRIEF DESCRIPTION OF THE DRAWINGS

FIG. 6(*b*) is a graph showing the relationship between the $NO_x$ emissions and spacing between the pairs of insert elements shown in FIG. 6(*a*);

FIG. 7(*b*) is a graph illustrating the temperature profile of the burner and flame insert of FIG. 1;

FIG. 8(*b*) is a diagrammatic, sectional view taken along the line 8(*b*)—8(*b*) in FIG. 8(*a*);

FIG. 9(*b*) is a diagrammatic, sectional view taken along the line 9(*b*)—9(*b*) in FIG. 9(*a*);

DETAILED DESCRIPTION OF THE DRAWINGS

Figure 1:
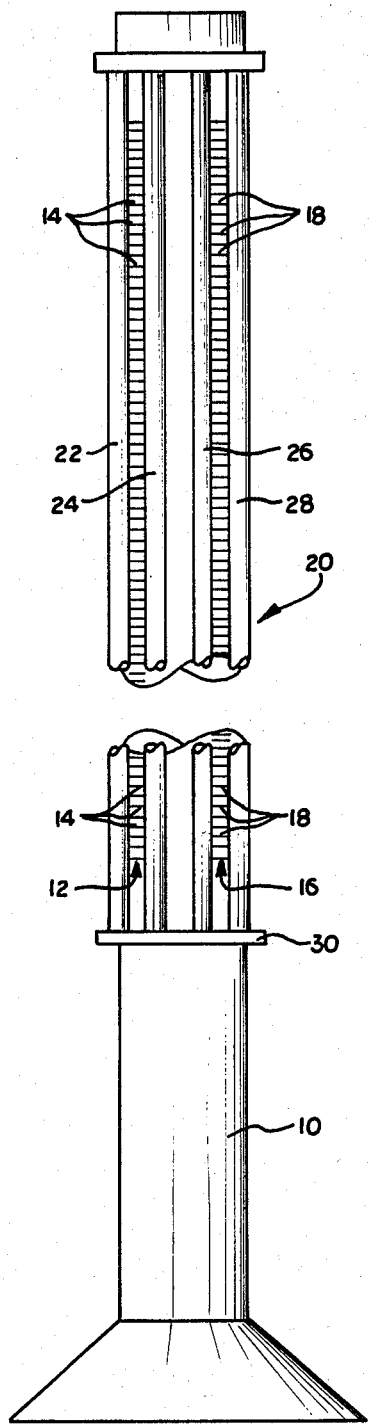
FIG. 1 is a top plan view of a burner having a flame insert mounted thereto in accordance with the present invention.
Figure 2:
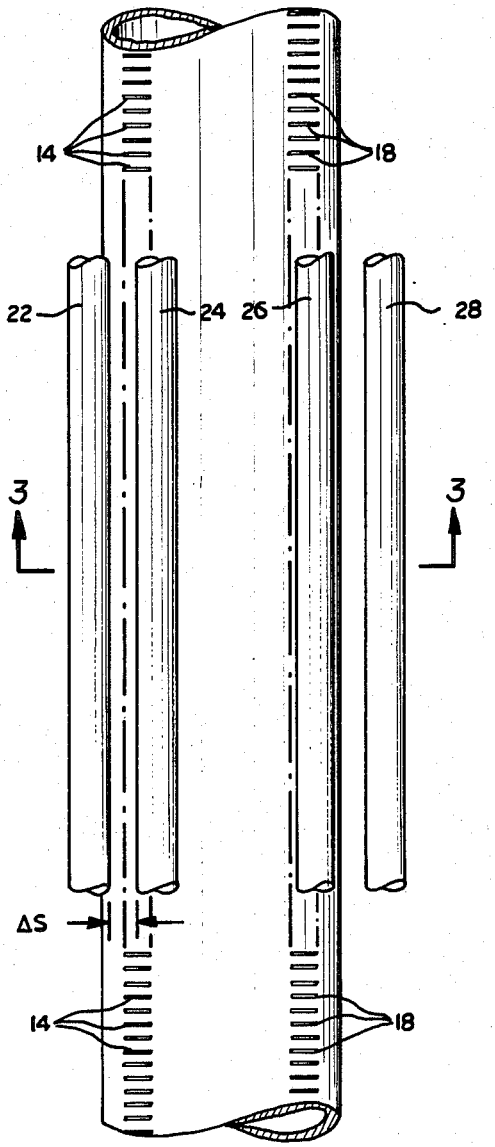
FIG. 2 is a fragmentary plan view, similar to FIG. 1, and on an enlarged scale.
Figure 3:
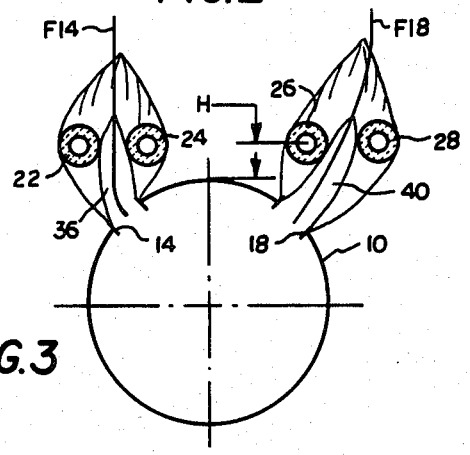
FIG. 3 is a diagrammatic, sectional view, taken along the line 3—3 in FIG. 2.

Referring to FIGS. 1 through 3, there is shown an atmospheric blue flame burner 10 of the type used for the combustion of natural gas in residential forced air furnaces. The burner 10 includes a first aligned row 12 of ports 14 and a second aligned row 16 of ports 18.

A flame insert assembly 20 includes elongated ceramic tubes 22 and 24 associated with ports 14 and ceramic tubes 26 and 28 associated with ports 18. The ceramic tubes are mounted to the burner 10 by means of tube supports 30 and 32 located adjacent opposite longitudinal ends of the ceramic tubes.

Referring to FIG. 3, the ports 14 and 18 are shown to be asymmetrical and, similarly, the arrays of flames extending respectively from the ports 14 and 16 are asymmetrical. The asymmetry is merely a result of piercing the two rows 12 and 16 from different directions during the manufacture of the burner 10, and it is mentioned herein to illustrate the ease of modifying the flame insert to individual burner designs. In this instance, the ceramic elements 26 and 28 are laterally offset slightly to the right in order to receive better the flames extending from the ports 18 as they pass upwardly under the influence of their natural buoyancy.

As discussed in greater detail hereinafter, the arrays of flames extending from each of the rows of ports have a tendency to assume a normal combustion position, as schematically shown in FIG. 3. More particularly, each of the flames extending from the port 14 includes an outer flame mantle 34 and an inner cone 36 which extend in a flame direction represented by the line F14. The ceramic tubes 22 and 24 are preferably located adjacent the inner cone 36 of the flame. Similarly, each of the flames of the array associated with ports 18 includes an outer flame mantle 38 and an inner cone 40, and extend in a flame direction represented by the line F18. Once again, the ceramic tubes 26 and 28 are preferably located adjacent the inner cone 40 of the flame.

The ceramic tubes are formed of alumina, and have an OD of $\frac{1}{4}$ inch and an ID of $\frac{1}{8}$ inch. For reference purposes, the ceramic tubes are indicated to be positioned above the burner 10 a height "H" equal to the distance between a horizontal plane passing through the centers of the tubes and a parallel horizontal plane which is tangent to the burner 10. The tube spacing "S" is equal to the distance between the adjacent sides of the associated tubes.

A comparison of the unmodified furnace burner 10 with the modified burner having flame insert assembly 20 including pairs of ceramic tubes is reported in Table I. In all cases, natural gas was used as a fuel gas for the burners.

TABLE I

| Burner | Fuel Input BTU/Hr. | % $CO_2$ in Sample | CO PPM/Air-Free | $NO_x$ Emission ng/J | % Reduction |
|---|---|---|---|---|---|
| Unmodified Furnace Burner | 125,000 | 4.39 | 8 | 77.4 @ 65.0%* | — |
| Double** Ceramic Tube | 125,000 | 5.10 | 18 | 33.5 @ 65.0%* | 57.3 |

*Seasonal efficiency
Tubes $\frac{1}{4}$ inch above burner with 3/16 inch spacing As reported, the $NO_x$ emission is reduced from a value of 77.4 ng/J to 33.5 ng/J. The $NO_x$ emission is reduced by 57.3%, and no significant change in burner efficiency occurs. A slight increase in CO emission is experienced as a result of the decrease in flame temperature due to the use of the flame insert 20** to reduce the $NO_x$ emission level.

The effect of the composition of the insert element upon the $NO_x$ reduction was evaluated. To that end, mullite tubes having dimensions identical with the alumina tubes and cordierite tubes having larger dimensions ($\frac{1}{2}$ inch OD by $\frac{1}{4}$ inch ID) were tested in a flame insert assembly corresponding with that shown in FIG. 3. In addition, each of the different tubes was coated with a silicone carbide paste, which had the effect of changing the radiative properties of the tube material. Further, alumina tubes were fitted with a metal core to evaluate the effect of density on the $NO_x$ reducing characteristics of the inserts. The results of these tests are reported in Table II.

TABLE II

| | Alumina | Alumina w/ SiC | Alumina w/ SiC & Core | Mullite | Mullite w/ SiC | $\frac{1}{2}$" diameter rod Cordierite | $\frac{1}{2}$" diameter rod Cordierite w/SiC |
|---|---|---|---|---|---|---|---|
| $NO_x$ (ppm/air-free) | 49.0 | 47.6 | 46.7 | 48.6 | 50.5 | 44.5 | 45.4 |
| N (ng/J) | 33.5 | 32.7 | 32.4 | 33.2 | 34.5 | 30.5 | 30.9 |
| CO (ppm/air-free) | 18 | 29 | 22 | 18 | 26 | 85 | 84 |
| $NO/NO_2$ Ratio | 9.79 | 9.34 | 12.0 | 9.94 | 8.38 | 3.09 | 3.76 |
| Linear Density (g/cm.) | .875 | .916 | 1.53 | .591 | .674 | 1.90 | 1.96 |
| Density ($g/cm^3$) | 3.67 | 3.84 | 4.83 | 2.48 | 2.83 | 2.00 | 2.06 |

*Position of the inserts was $\frac{1}{4}$ inch above the top of the burner to the tube centerline and the distance between the tubes was 3/16 inch.

As indicated in Table II, the $\frac{1}{4}$ inch OD by $\frac{1}{8}$ inch ID ceramic compositions displayed no significant difference in emission characteristics. Further, the use of a metallic core in an alumina tube did not significantly alter the emission reduction and confirms that variation of the surface area is not limited or dominated by undesirable peak flame temperature changes resulting from mass changes associated with such surface area variations.

The larger-sized cordierite tubes resulted in a small additional reduction in $NO_x$ emission, a slightly higher CO emission, and a lower $NO/NO_2$ ratio. Those changes may be associated with the increased mass and/or surface extent of the larger cordierite tubes. However, the limited influence of mass upon the effectiveness of $NO_x$ emission reduction is readily illustrated by comparison of the emission factor values and linear density values for the alumina and cordierite tubes. For example, the silicone carbide coated alumina and cordierite tubes respectively display emission factors of 32.7 and 30.9 ng/J and linear densities of 0.916 and 1.96 g/cm.

In addition of the foregoing materials, $\frac{1}{4}$ inch diameter stainless steel rods (Type 308 stainless) positioned in the same manner as the ceramic tubes were evaluated. The steel rods exhibited $NO_x$ emissions of 43.7 ppm/air-free and a CO emission of 16 ppm/air-free. The $NO_x$ emission factor N was equal to 29.6 ng/J using 65.0% efficiency. Alumina tubes tested the same day gave $NO_x$ emissions of 45.2 ppm/air-free and an emission factor N equal to 30.6 ng/J at 65.0% efficiency. There appear to be similar $NO_x$ reducing characteristics for the steel rods.

Figure 4:
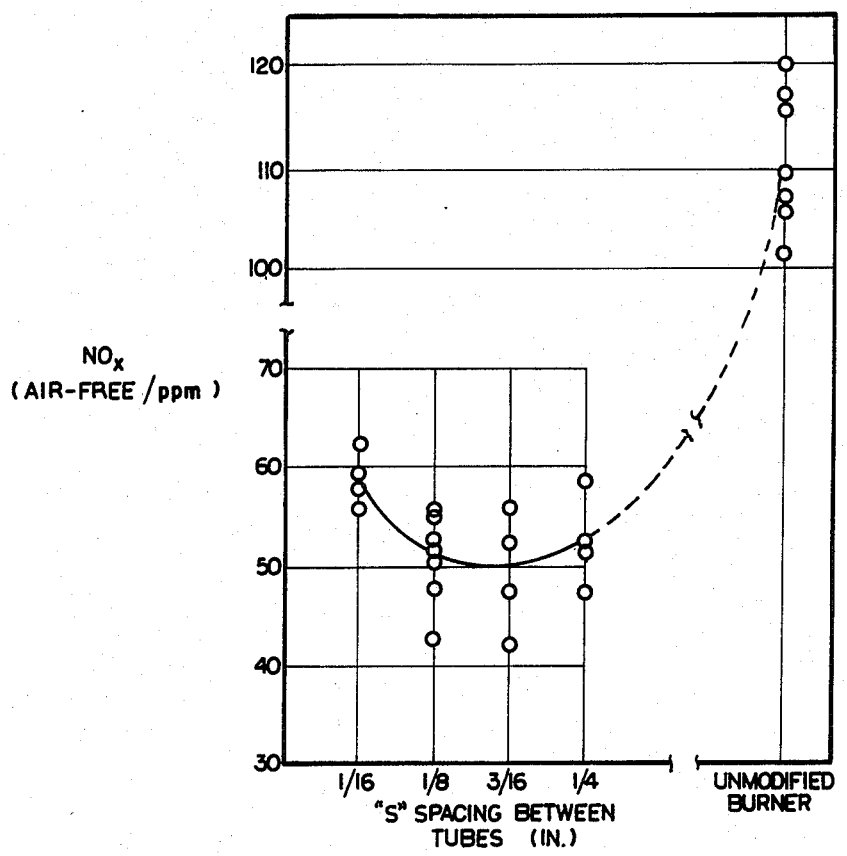
FIG. 4 is a graph showing the relationship between $NO_x$ emission and the spacing between the adjacent insert elements of the flame insert shown in FIG. 1.

The spacing between the ceramic tubes 22, 24 and between the tubes 26,28 was varied in order to determine the effect upon $NO_x$ emissions. The spacing between each of the members of the pairs of tubes was varied from 1/16 to $\frac{1}{4}$ inch, and the tubes were maintained at a constant height of $\frac{1}{4}$ inch. The variation in $NO_x$ emission measured in ppm $NO_x$/air-free is shown in FIG. 4 as a function of the spacing between the ceramic tubes associated with each of the rows of ports. In addition, the $NO_x$ emission for an unmodified burner is also indicated. A minimum value of 49.8 ppm $NO_x$ at a spacing slightly less than 3/16 inch was observed.

Figure 5:
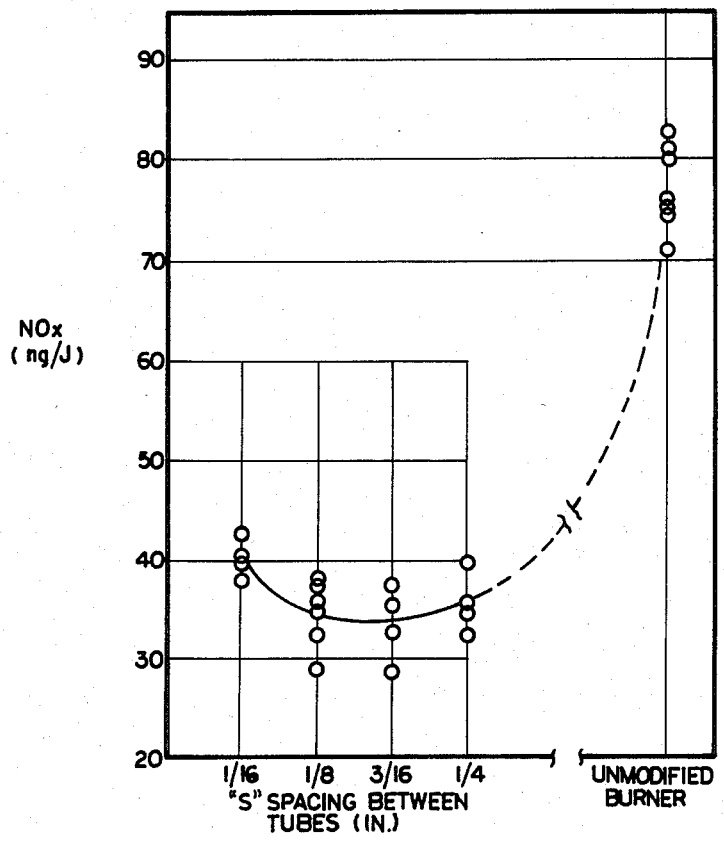
FIG. 5 is a graph similar to that of FIG. 4, but showing the $NO_x$ emission in terms of nanograms/joule of useful heat.

Referring to FIG. 5, the effect on the emission level or factor N is shown for the various spacings of the ceramic tubes. Once again, the emission factor for the unmodified burner is also reported. A minimum of 34.2 ng/J at a spacing of slightly less than 3/16 inch is observed. Only two points showed emission factors slightly higher than the desired 40.0 ng/J: 40.7 and 42.8 ng/J, occurring at a spacing of 1/16 inch and a height of $\frac{1}{4}$ inch.

It is apparent from FIGS. 4 and 5 that the flame insert assembly 20 effectively reduces the $NO_x$ emissions. Further, the relative proximity of the ceramic tubes associated with a particular burner may be varied within certain limits. The maintenance of acceptable performance over a range of tube spacing illustrates the lack of dimension criticality in assembling original burner-inserts or retrofitting existing burners. The ability of the insert to accommodate flame variations or transient deviations during combustion having similar position effects to those evaluated herein is also demonstrated.

Figure 6A:
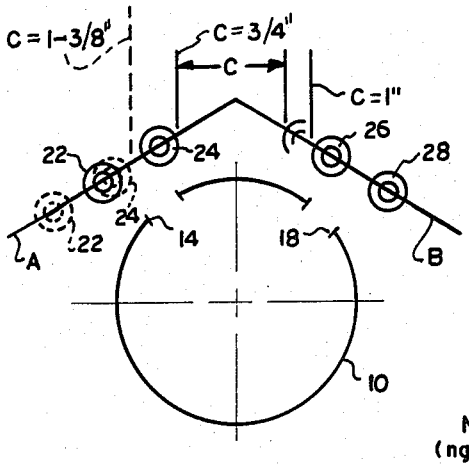
FIG. 6(*a*) is a diagrammatic, sectional view similar to FIG. 3, but showing a modified insert element arrangement.
Figure 6B:
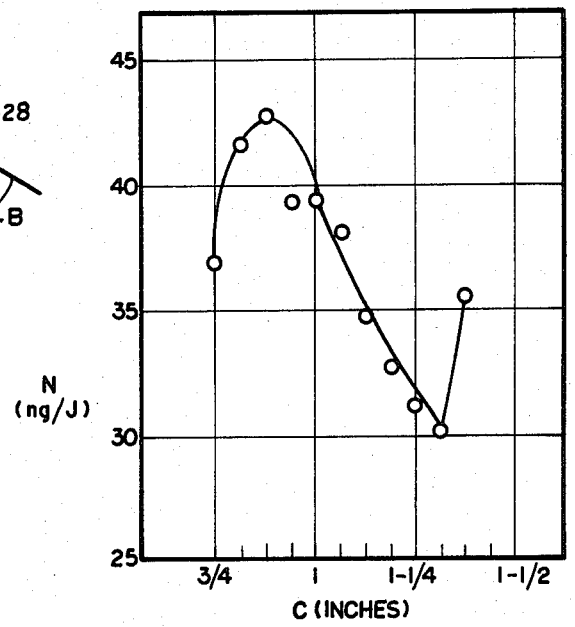

Referring to FIGS. 6(*a*) and 6(*b*), the effects of different angular orientations of the tubes and the radial alignment of the pairs of tubes with the ports are evaluated. As diagrammatically shown in FIG. 6(*a*), the pairs of ceramic tubes 22,24 and 25,28 were disposed in planes indicated by the lines A,B arranged at an angle of 120 degrees to one another. The $NO_x$ emissions were evaluated at the indicated values of the distance "C" between the pairs of tubes.

Referring to FIG. 6(*b*), the reduction in $NO_x$ emissions is responsive to the variation of the distance between the pairs of the ceramic tubes. Similar results are obtained in corresponding flame insert assemblies wherein the angle between the planes was 90 degrees. Howeer, it is believed that the angle of the planes does not have a significant effect on the $NO_x$ emission level.

Although variations in the $NO_x$ emission level are obtained with variation of the dimension C in FIG. 6(*a*), it should be appreciated that in all cases, the $NO_x$ emission levels are substantially reduced as compared with the unmodified burner. Accordingly, these tests also demonstrate the effectiveness of the ceramic elements to receive the flames and maintain effective contact with the inner cones despite relative position variations between the ceramic tubes and the ports as well as the corresponding differences represented by flame variations during combustion.

Referring to the lefthand plane indicated by the line A in FIG. 6(*a*), the positions of the ceramic tubes at a distance of $\frac{3}{4}$ inch are shown in solid line and the positions of the ceramic tubes at a distance of $1\frac{3}{8}$ inches are shown in dotted outline. Appreciating that the $NO_x$ emission level for this variation in spacing is not degraded to unacceptable levels, the effectiveness of the ceramic tubes in accordance with the present invention to direct a flame to a position therebetween and to maintain the inner cone in effective cooling proximity with the adjacent tube surfaces is demonstrated. This is further illustrated below with respect to water heater applications.

It is not anticipated that steady state combustion will include lateral displacements of the flame or flame height variations comparable to those represented by the above-illustrated variation of the element positions. Even if so varied, the ceramic tubes effectively capture the flame, and more importantly the inner cone thereof, within a channel defined between the tubes so as to maintain the inner cone in effective cooling proximity with the tubes.

The accommodation of flame variation is related to the size of the element surface which is adjacent to the inner cone of the flame and available for guiding and cooling the flame. In the case of a cylindrically shaped insert as illustrated in certain of the embodiments, approximately 90° of its angular peripheral or circumferential extent is readily accessible and available for cooling contact with the flame inner cone which tends to conform with arcuate surface shape. This results in a surface extent in the flame direction of about 3/16 inch as measured along the periphery of the illustrated $\frac{1}{4}$ inch OD alumina tube. This dimension is of a size comparable to the anticipated variations in the height of the flame inner cone in typical furnace applications of the illustrated burner. The $\frac{1}{2}$ inch OD cordierite tube has a surface extent of about $\frac{3}{8}$ inch with which the flame inner cone may readily conform and contact. In the orthogonal direction, the extent of the element surface available for flame contact corresponds with the longitudinal length of the tube.

A peripheral extent of the tube adjacent the flame cooling portion is believed to provide a flame guiding portion which serves to direct the flame into contact with the flame cooling portion. This flame guiding portion may be located just ahead of the flame cooling portion and comprise an additional 10% to 25% of the angular peripheral extent of the illustrated cylindrical inserts. The sizes and positions of the flame guiding and cooling portions will vary in accordance with the combustion process and the portions may effectively overlie one another in view of chimney or draft effects discussed below.

The accommodation of flame variation is also believed to be associated with the flow-inducing chimney or draft effect of the opposed surfaces of the flame insert. The opposed surfaces operate to center the flame therebetween with the inner cone contacting and passing along the surfaces. The outer flame mantle may engulf or pass around the insert structure adjacent to the surfaces without apparent effect upon the emission reductions.

One of the major contributing factors in the fixation of atmospheric or thermal nitrogen fo form NO and $NO_2$ is the flame temperature. This dependency on temperature is due to the high activation energy associated with the reaction. Accordingly, it is presently believed that a reduction of the peak flame temperature is the main contribution to the effectiveness of the flame insert assembly of the present invention.

Figure 7A:
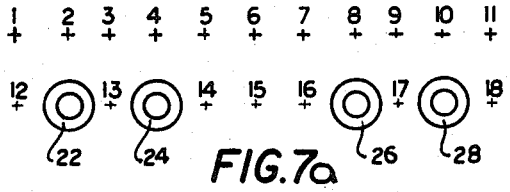
FIG. 7(*a*) is a diagrammatic, sectional view illustrating the position of the insert elements and thermocouple probes used to develop a temperature profile for the burner and flame insert of FIG. 1.
Figure 7B:
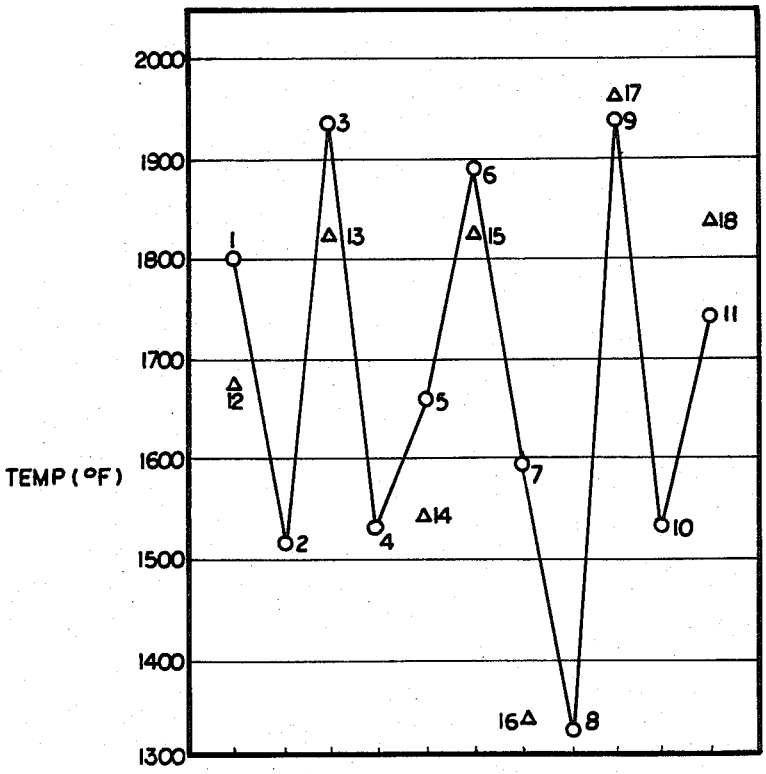

For purposes of evaluating the peak flame temperature, thermocouple temperature readings were taken at each of the 18 numbered locations shown in FIG. 7(*a*) with respect to the flame insert assembly 20, as shown in FIG. 3. Such measurements were taken for each of the ceramic compositions shown in Table III, wherein the results are reported. The bulk flame temperature is shown as the mean±one standard deviation for the 18 measurements. The unmodified burner temperatures are the average of about 6 points.

FIG. 7(*b*) shows a graphical representation of the results of one of the tests. As shown, the highest temperatures occurred between pairs of ceramic tubes, with the lowest reading adjacent to the tubes. Minimum temperatures occurred at the points directly above the tubes. This pattern of temperatures is typical for the different ceramic materials evaluated.

TABLE III

| Ceramic Material | Peak Temperature °F. | Location of Peak Temperature | Bulk Temperature °F. | Ng ng/J @ 65% Seas. Effic. |
|---|---|---|---|---|
| Unmodified* | 2496 | N/A | 2053 ± 363 | 78.4 |
| Alumina | 1942 | 1 | 1682 ± 151 | 32.9 |
| | 1926 | 3 | | |
| Mullite | 2011 | 1 | 1733 ± 200 | 30.8 |
| Alumina | 2312 | 6 | 1897 ± 183 | 35.1 |
| w/Metal core | 2125 | 3 | | |
| Mullite | 2087 | 1 | 1749 ± 231 | 34.1 |
| w/SiC Coating | 2049 | 3 | | |
| Alumina w/Metal Core and SiC Coating | 1957 | 3 | 1665 ± 256 | 34.1 |
| Alumina | 2170 | 1 | 1427 ± 278 | 32.3 |
| w/SiC Coating | 2072 | 3 | | |
| Cordierite | 2049 | 9 and 17 | 1738 ± 273 | 29.5 |
| Cordierite | 2125 | 17 | 1812 ± 308 | 30.9 |
| w/SiC Coating | 2087 | 3 | | |

*Positions do not correspond to others; average of about six points is reported.

In comparison with the unmodified burner which displayed temperatures ranging between 1600° F. and 2500° F. The flame temperatures obtained upon use of the flame insert varied between 1300° F. and 2100° F. Accordingly, the flame insert assembly of the present invention was found to effectively lower the peak flame temperatures by several hundred degrees Fahrenheit. The average bulk flame temperature is also reduced so as to result in lower $NO_x$ emissions.

Figure 8A:
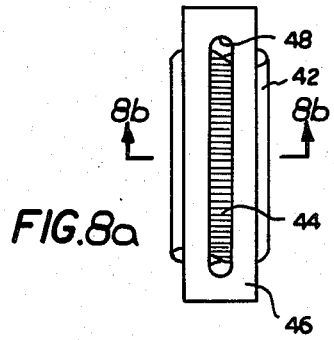
FIG. 8(*a*) is a top plan view of a modified flame insert and burner in accordance with the present invention.
Figure 8B:
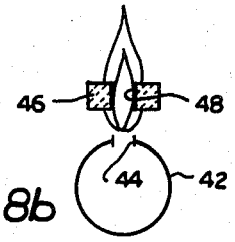

Referring to FIGS. 8(*a*) and 8(*b*), another embodiment of the present invention is shown. A burner 42 having a single aligned row of ports 44 is provided with an elongated insert element 46. The element 46 includes an elongated aperture 48 overlying the ports 44 and adapted to receive the flames extending therefrom. As illustrated, the inner cone extends along and freely passes over the opposed surfaces or sides of the aperture 48.

Figure 9A:
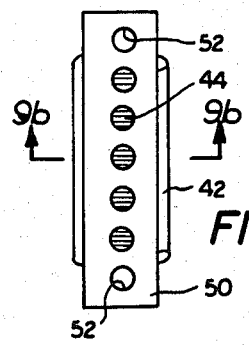
FIG. 9(*a*) is a top plan view of a modified flame insert and burner in accordance with the present invention.
Figure 9B:
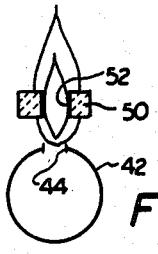

Referring to FIGS. 9(*a*) and 9(*b*), a modified insert element 50 is shown for use with the burner 42. The element 50 includes a plurality of apertures 52 overlying the ports 44. Each of the apertures 52 includes a cylindrical surface for receiving and contacting the inner cone of the flame emitted from the adjacent port 44.

Figure 10:
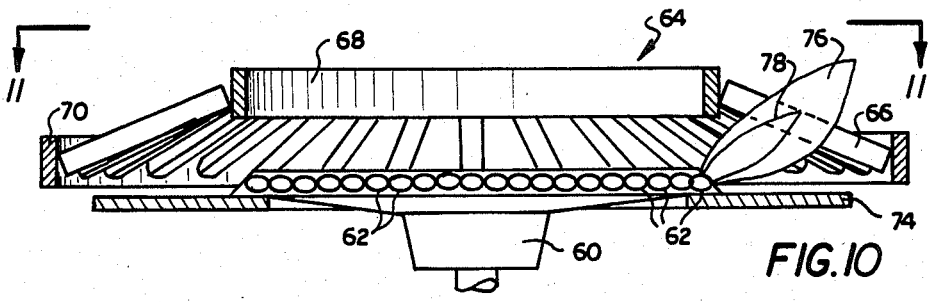
FIG. 10 is a diagrammatic side elevational view of a burner having a circular array of ports and a flame insert in accordance with the present invention.
Figure 11:
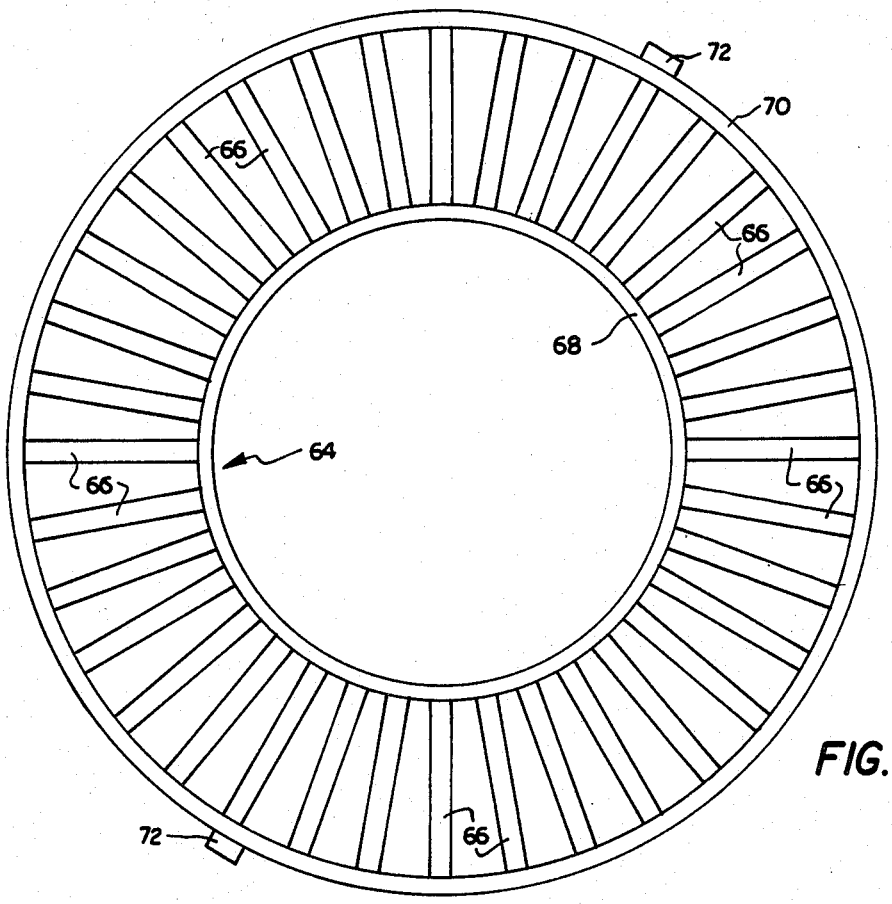
FIG. 11 is a top plan view of the flame insert shown in FIG. 10.

Referring to FIGS. 10 and 11, an atmospheric burner 60 having a circular array of ports 62 is shown. This is the type of burner typically used in a residential water heater.

A flame insert assembly 64 includes a plurality of ceramic tubes 66 extending between an inner support ring 68 and an outer support ring 70 in a truncated cone configuration. The tubes 66 are of the same composition and cross-sectional configuration as the tubes 22, 24, 26 and 28. The assembly 64 is mounted in a fixed position relative to the burner 60 by means of mounting tabs 72 extending from the outer support ring 70. As discussed more fully below, a secondary air baffle 74 may be used in connection with the insert.

As indicated, the ceramic tubes 66 are arranged in a truncated cone pattern. In a preferred arrangement, a ceramic tube 66 may be located at angularly intermediate positions between each of the flames 76 extending from the ports 62.

In this embodiment, the flame guiding and cooling portions comprise circumferentially abutting surface regions extending along the length of each of the tubes 66. Such surface regions generally correspond with extent of the tube 66 directly behind the flame 76 and its cone 78 as shown in dotted line in FIG. 10, the flame guiding portion being provided by the lower surface region adjacent the port 62 and the flame cooling portion being provided by the abutting upper surface region. Accordingly, each adjacent pair of tubes 66 cooperates to confine the flame 76 extending therebetween and to maintain the inner cone 78 in contact with the surface regions.

In addition, the secondary air baffle 74 may be positioned below the burner and the flames extending from the ports 62 in order to restrict the secondary air. In such an arrangement, two different emission regulation techniques have been combined to complement one another. More particularly, the tubes 66 serve to reduce the peak flame temperatures and $NO_x$ emissions to a significant level and further reductions are limited by excessive CO emissions occurring due to the decreased temperatures. The addition of the secondary air baffle further reduces the NO emission level to the desired value without increasing the CO emission. The use of a baffle or shield in order to impede the ingress of secondary air into the flame zone of the burner 60 has been found effective to lower the $NO_x$ emissions from the burner and such is believed to be a result of restricting the availability in the flame zone of the reactants required for $NO_x$ formation.

The secondary air baffle alone has not been found to reduce $NO_x$ emissions significantly. However, the baffle in cooperation with the flame insert assembly has been found to effectively reduce the $NO_x$ emissions. Accordingly, the flame insert assembly 64, together with the secondary baffle 74, was tested on three different sized water heaters, as reported in Table IV. As indicated, $NO_x$ emissions were reduced below the desired 40 ng/J standard in connection with the 30 and 50-gallon size water heaters. Similarly, CO emissions were maintained within acceptable levels well below the 400 ppm regulation limit, or actually decreased in the case of the 50-gallon unit. In all cases, efficiencies were retained.

TABLE IV

| BURNER | FUEL INPUT BTU/HR. | % $CO_2$ IN SAMPLE | CO PPM/AIR-FREE | $NO_X$ EMISSION ng/J | % REDUCTION |
|---|---|---|---|---|---|
| UNMODIFIED WATER HEATER BURNER | | | | | |
| 30-gallon | 29,440 | 5.65 | 21 | 86.4 @ 76.7%* | — |
| 40-gallon (Derate) | 39,800 | 2.75 | 130 | 70.0 @ 79.0% | — |
| 50-gallon | 49,665 | 3.70 | 264 | 56.4 @ 79.9% | — |
| CERAMIC INSERT MODIFICATION (FIGS. 10, 11) | | | | | |
| 30-gallon | 29,810 | 5.84 | 74 | 39.0 @ 75.0% | 54.9 |

TABLE IV-continued

| BURNER | FUEL INPUT BTU/HR. | % $CO_2$ IN SAMPLE | CO PPM/AIR-FREE | $NO_X$ EMISSION ng/J | % REDUCTION |
|---|---|---|---|---|---|
| 40-gallon (Derate) | 40,260 | 2.80 | 85 | 49.1 @ 79.0% | 29.9 |
| 50-gallon | 50,420 | 3.45 | 235 | 36.0 @ 79.2% | 36.2 |

*Recovery efficiency

Figure 12:
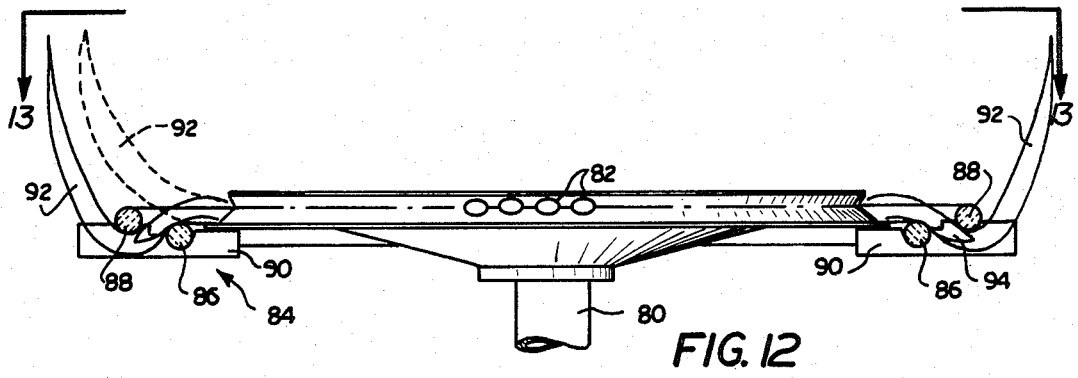
FIG. 12 is a diagrammatic view similar to FIG. 10 of another embodiment of a flame insert for a burner having a circular array of ports.
Figure 13:
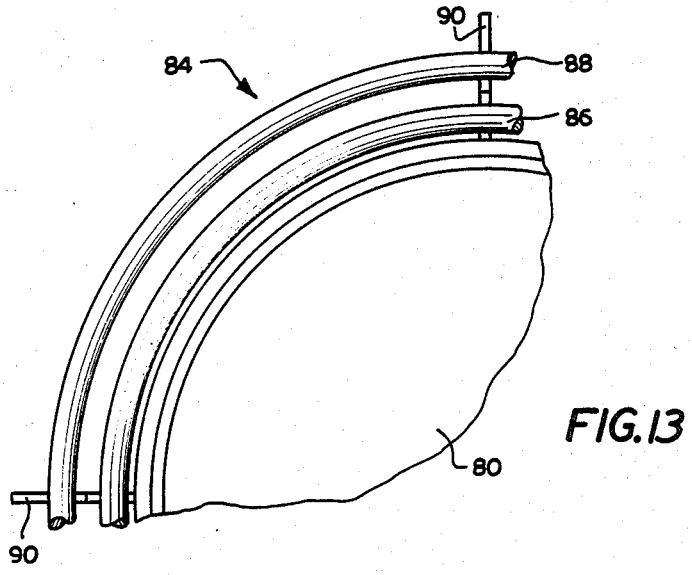
FIG. 13 is a fragmentary, top plan view of the flame insert and burner of FIG. 12.

Referring to FIGS. 12 and 13, an atmospheric burner 80 having a circular array of ports 82 is shown. The burner 80 is similar to the burner 60 and it is also of the type used in residential hot water heaters.

A modified flame insert assembly 84 is mounted to the burner 80. The insert 84 includes a pair of circular rings 86 and 88 which have different diameters for purposes of mounting them in a spaced concentric arrangement. Each of the rings 86 and 88 is formed of a $\frac{1}{4}$ inch diameter stainless steel rod material (Type 308 stainless). The rings are mounted to the burner 80 by four angularly spaced, stepped brackets 90, only two of which are shown.

The rings 86 and 88 extend around the periphery of the circular array of ports 82 to provide a common channel therebetween for receiving flames 92 with the inner cones 94 in contact with spaced surface regions of the rings. To that end, the rings 86 and 88 are both radially and axially spaced from one another. The outer ring 88 is positioned in a horizontal plane located slightly below the plane of the ports 82 and the inner ring 86 is disposed in a parallel plane located below the plane of the ring 88. Accordingly, the rings 86, 88 cooperate to define a radially outward and downwardly extending circular channel which surrounds the ports 82 and receives the array of flames 92.

The insert 84 is located to demonstrate the flame guiding and positioning effects achieved in accordance with the invention. More particularly, the rings 86 and 88 guide the flames 92 to the illustrated position therebetween, remote from the flame's normal combustion position shown in dotted line. Thus, the rings 86 and 88 are unexpectedly effective in guiding and maintaining the flames 92 in a desired position, even if such position is spaced from the flame's normal combustion position. In such position herein, the flame direction initially extends horizontally and downwardly contrary to the flame's natural buoyancy. Upon passing between the rings, typical flame positioning occurs and the flame direction curves upwardly in accordance with the natural buoyancy of the flame.

The operation of the burner 80 without a flame insert and with the insert 84 positioned as shown are compared in Table V.

TABLE V

| BURNER | FUEL INPUT BTU/HR. | % $CO_2$ IN SAMPLE | CO PPM/AIR-FREE | $NO_X$ EMISSION nq/J | % REDUCTION |
|---|---|---|---|---|---|
| UNMODIFIED WATER HEATER BURNER | 29,951 | 11.6 | 220 | 53.4 @ 70.0%* | — |
| STAINLESS STEEL INSERT MODIFICATION (FIGS. 12, 13) | 31,091 | 10.8 | 570 | 28.9 @ 70.0%* | 45.9 |

*Recovery efficiency

As shown, the insert 84 reduced the $NO_x$ emission of the burner by 45.9% without optimization of position as to the overall combustion process. The CO emission may be reduced to less than 400 ppm by such optimization together with routine burner adjustment to reduce the overall $CO_2$ concentration. However, the operation of the insert 84 is especially intended to emphasize the unexpected flame guiding and positioning of the insert.

The effectiveness of the inserts of the present invention to accommodate flame variations has been further demonstrated by compliance with the American National Standards requirements relating to operating test pressures and rated inputs. These requirements, as more fully discussed below, essentially require safe appliance operation under conditions ranging from less than about one-half the standard gas line operating pressure to an excess gas line pressure supply resulting from an overrated input in the order of about 112% of the manufacturer's rated input. Appliance operation over such range of conditions causes corresponding variations of the flames from their normal combustion positions. Thus, the inserts of the present invention have displayed their effectiveness in reducing $NO_x$ emissions and otherwise maintaining acceptable burner combustion over the range of gas pressure supply variations.

In accordance with the American National Standards, the operation of the appliance is tested at gas line test pressures of $3\frac{1}{2}$ and $10\frac{1}{2}$ inches water column as well as the standard 7 inches water column. These test pressures are measured just ahead of the appliance controls, which will result in low gas supply pressure operation of the appliance but avoid high or excess pressure operation. The latter is tested by operation of the appliance at an overrated input. In the case of residential forced air furnaces, the furnace is tested at 112% of the manufacturer's rated input, which is usually specified in BTU/hr. Residential hot water heaters are tested at a manifold pressure which is 112.5% of the manifold pressure, which results in the manufacturer's rated input for the appliance. Herein, these conditions of overrated input are referred to as overrated heat input for both furnaces and water heaters, with the understanding that the appropriate standard is to be considered for the specific appliance.

The insert assemblies 20, 64, and 84 have each maintained $NO_x$ emission reductions and acceptable combustion for flame variations resulting upon testing of the various appliances in accordance with the American National Standards. Similarly, the insert assemblies have provided acceptable performance with transient deviations of flame position which are in the range of about $\frac{1}{8}$ inch position movement in the flame direction for a one-inch flame. The insert assemblies also readily accommodate flame variations resulting from fuel gas composition changes or burner dirt, which variations are each estimated to be about $\frac{1}{4}$ to $\frac{1}{2}$ inch in the flame direction for a one-inch flame.

The foregoing embodiments illustrate and characterize the inventions and discoveries herein with respect to the reduction of $NO_x$ emission in atmospheric type burners. A variety of flame insert configurations have been found to reduce $NO_x$ emission and accommodate flame variation. The various embodiments also illustrate the convenience and effectiveness of cylindrical shaped insert elements in both linear and circular flame arrays with such elements being longitudinally aligned or radially intersecting the flame arrays. In both cases, the arcuate surface configuration is especially advantageous since it provides an adequate peripheral extent to accommodate flame variations and two adjacent elements provide suitable channels for receiving the flames.

Although the preferred embodiment of this invention has been shown and described, it should be understood that various modifications and rearrangements of the parts may be resorted to without departing from the scope of the invention as disclosed and claimed herein.

What is claimed is:

1. An atmospheric burner assembly including an array of ports arranged in a substantially circular pattern to provide a corresponding array of blue flames extending therefrom during combustion of a fuel gas, said array of flames tending to assume a normal combustion position under the influence of the natural buoyancy of the flames during combustion, each of said flames including an inner cone and an outer flame mantle, flame insert means mounted to said burner assembly for contacting said array of flames and reducing the peak flame temperature by radiating heat energy away from the flames, said flame insert means comprising a pair of substantially circular ring insert elements of different diameters which are concentrically disposed about said array of ports, said insert elements including insert surfaces located adjacent said inner cones when said array of flames assumes its normal combustion position, said insert surfaces being spaced from one another with said inner cones of said flames extending between and engaging said insert surfaces during combustion.

2. An atmospheric burner as set forth in claim 1, wherein said insert surface means define a common channel for receiving and maintaining said array of flames in said normal combustion position.

3. An atmospheric burner as set forth in claim 1, wherein a baffle assembly is provided to regulate the flow of secondary air to said flames.

4. An atmospheric burner as set forth in claim 1, wherein said insert surfaces induce said flames to travel along the profile of such surfaces.

5. An atmospheric burner assembly as set forth in claim 1, wherein said flame insert means is mounted to said burner assembly at mounting locations remote from said flames to limit substantially all flame contact to engagement with said insert surfaces.

6. An atmospheric burner assembly as set forth in claim 1, wherein each of said insert elements has a cross-sectional diameter of at least $\frac{1}{4}$ inch.

7. An atmospheric burner assembly as set forth in claim 1, wherein said means comprise insert means comprise insert elements are formed of a ceramic material selected from the group consisting of alumina, cordierite, and mullite.

8. An atmospheric burner assembly including an array of ports adapted to have a corresponding array of blue flames extending therefrom during combustion of a fuel gas and a flame insert member for reducing the $NO_x$ emission of the burner assembly, said array of flames tending to assume a normal combustion position during combustion under the influence of the natural buoyancy of the flames during combustion, said flame insert member being rigidly mounted to said burner assembly and providing an assembly of elongated insert elements which are spaced from each other and from the burner, pairs of said insert elements extending along said array of ports and including exterior surface portions providing spaced insert surfaces for contacting said array of flames and reducing the peak flame temperature by radiating heat energy away from the flames, said flames having inner cones, said insert surfaces inducing said inner cones of said flames to extend between and engage said insert surfaces during combustion.

9. An atmospheric burner assembly as set forth in claim 8, wherein said burner assembly is adapted for use in a gas-fired apparatus capable of operation over a range of fuel gas inputs below and above predetermined conditions or rated inputs which tend to cause the position of said array of flames to correspondingly vary from said normal combustion position, and said insert surfaces are of a size such that said inducement of said flames to travel along the surfaces maintains said inner cones in contact with the surfaces during operation of said burner over said range of fuel gas inputs.

10. An atmospheric burner assembly as set forth in claim 9, wherein said $NO_x$ emission is reduced to substantially 40 nanograms/joule of useful heat or less.

11. An atmospheric burner assembly as set forth in claim 8, wherein said flames experience variations in length in the range of from about $\frac{1}{8}$ to $\frac{1}{2}$ inch during combustion and said insert surfaces are of a size such that said inducement of said flames to travel along the surfaces maintains said inner cones in contact with the surfaces throughout said range of flame lengths.

12. An atmospheric burner assembly as set forth in claim 8, wherein said array of ports is arranged in a circular pattern, said insert elements have longitudinal axes extending radially with respect to said circular pattern of ports, and said insert elements are positioned between the flames of adjacent ports.

13. An atmospheric burner assembly as set forth in claim 8, wherein each of said flames extends along its length from its associated port in a flame direction and during combustion experiences predetermined deviations in its length in the flame direction or its lateral alignment along the flame direction, and said insert surfaces are of a size such that said inducement of said flames to travel along the surfaces maintains said inner cones in contact with the surfaces during operation of said burner.

14. An atmospheric burner assembly as set forth in claim 8, wherein said insert elements have a cylindrical configuration and a cross section diameter of at least $\frac{1}{4}$ inch.

15. An atmospheric burner assembly as set forth in claim 8, wherein said insert elements comprise hollow tubes.

16. An atmospheric burner assembly as set forth in claim 8, wherein said insert elements are of a nonmetallic material.

17. An atmospheric burner assembly as set forth in claim 8, wherein said insert elements are of a metallic material.

18. An atmospheric burner assembly as set forth in claim 8, wherein said burner assembly is adapted to be incorporated in a gas-fired appliance having a standard gas line operating pressure equal to about 7 inches water column and a rated heat input specified in BTU/hr., said gas-fired appliance also being capable of operation over a minimum range of conditions extending from a lower gas line operating pressure equal to about $3\frac{1}{2}$ inches water column to a higher overrated heat input equal to about 112% of said rated heat input, and said insert surfaces are of a size such that said inducement of said flames to travel along the surfaces maintains said inner cones in contact with the surfaces during operation of said burner over said minimum range of conditions.

19. In an atmospheric type burner including a port adapted to have a blue flame extend therefrom during combustion of a fuel gas, said flame having a length extending in a flame direction from said port during combustion and under the influence of its natural buoyancy tending to assume a normal combustion position, said flame including an inner cone and an outer flame mantle, the improvement comprising flame insert means including flame guiding and cooling means comprising first and second flame insert elements providing at least two spaced insert surfaces located adjacent said inner cone when said flame assumes its normal combustion position, said insert surfaces extending in substantially said flame direction with said inner cone extending therealong during combustion to reduce the peak flame temperature by radiating heat energy away from said flame, said insert surfaces being spaced from said burner and inducing said flame to travel along the profile of such surfaces with the inner cone of the flame extending between and engaging such surfaces, each of said flame insert elements having an elongated configuration and a substantially circular cross-sectional shape.

20. The atmospheric burner as set forth in claim 19, wherein said flame insert means includes secondary baffle means for restricting the flow of secondary air to said flame and further reducing $NO_x$ emission.

21. The atmospheric burner as set forth in claim 19, wherein said flame guiding and cooling means are supported by said burner at mounting locations substantially remote from said flame to limit substantially all flame contact to engagement of the flame with said insert surfaces.

22. The atmospheric burner as set forth in claim 19, wherein each of said first and second flame insert elements has a cylindrical configuration and said elements are spaced from one another for receiving said flame therebetween in said normal combustion position.

23. In an atmospheric burner assembly including at least one port adapted to have a blue flame extend therefrom during combustion of a fuel gas, said flame including an inner cone and outer flame mantle, said flame having a length extending in a flame direction from said port during combustion and under the influence of its natural buoyancy tending to assume a normal combustion position, said flame varying in length a predetermined amount during burner operation, the improvement comprising a flame insert assembly for reducing the $NO_x$ emission of the burner assembly, said flame insert assembly being rigidly mounted to said burner assembly and providing at least two elongated insert surface portions for contacting said flame and reducing the peak flame temperature by radiating heat energy away from the flame, said flame engaging and freely passing over said insert surface portions during combustion, said insert surface portions being located adjacent said inner cone of said flame at said normal combustion position and extending in said flame direction a distance at least equal to said predetermined amount of variation of flame length, said insert surface portions being spaced from said burner assembly, and said flame insert assembly being affixed to said burner assembly at mounting locations substantially remote from said flame to limit substantially all flame contact to engagement of the flame with said insert surface portions.

24. The atmospheric burner as set forth in claim 23, wherein said inner cone of said flame has a peripheral extent at an intermediate location along the length thereof and said insert surface portions extend along the peripheral extent of said inner cone of said flame in said normal combustion position.

25. The atmospheric burner as set forth in claim 23, wherein said insert surface portions induce said flame to travel along the profile of such surface portions and seek said normal combustion position.

26. The atmospheric burner as set forth in claim 23, wherein said distance which said insert surface portions extend in said flame direction is equal to at least 3/16 inch.

27. The atmospheric burner as set forth in claim 26, wherein said distance which said insert surface portions extend in said flame direction is in the range of from about 3/16 inch to about $\frac{3}{8}$ inch.

28. The atmospheric burner as set forth in claim 23, wherein said inner cone of said flame has a peripheral extent at an intermediate location along the length thereof and said insert surface portions laterally confine at least two opposed regions of the peripheral extent of said inner cone of said flame in said normal combustion position.

29. An atmospheric burner assembly including an array of ports adapted to have a corresponding array of blue flames extending therefrom during combustion of a fuel gas, said flames including inner cones and outer flame mantles, and a flame insert member for reducing the $NO_x$ emission of the burner assembly, said flame insert member providing pairs of elongated insert elements spaced from each other and from the burner assembly, said insert elements extending along said array of ports and including spaced surface portions for contacting said array of flames and reducing the peak flame temperature by radiating heat away from the flames, said spaced surface portions being adapted to induce said inner cones of said flames to travel along and engage the profile of such surface portions and said flame insert member being mounted to said burner assembly at mounting locations substantially remote from said flames to limit substantially all flame contact to engagement with said surface portions.

30. An atmospheric burner assembly as set forth in claim 29, wherein each of said spaced surface portions extends in said flame direction a distance equal to from about 3/16 inch to about $\frac{3}{8}$ inch.

31. An atmospheric burner assembly as set forth in claim 29, wherein each of said flames has a length extending in a flame direction from its associated port and during combustion experiences predetermined deviations in its length in the flame direction or its lateral alignment along the flame direction, and said insert surface portions are of a size such that said inducement of said flames to travel along said surface portions maintains said flames in contact with the surface portions.

32. An atmospheric burner assembly as set forth in claim 31, wherein said each of said insert elements has a tubular configuration.

33. An atmospheric burner assembly as set forth in claim 31, wherein said each of said insert elements comprises an elongated rod member.

* * * * *

UNITED STATES PATENT AND TRADEMARK OFFICE

CERTIFICATE OF CORRECTION

PATENT NO. : 4,525,141

DATED : June 25, 1985

INVENTOR(S) : Douglas W. DeWerth et al.

It is certified that error appears in the above-identified patent and that said Letters Patent are hereby corrected as shown below:

Column 3, line 20, delete "are", second occurrence;

Column 3, line 30, delete "metal" and substitute therefor --metals--;

Column 7, line 27, delete "25" and substitute therefor --26--;

Column 13, line 47, delete "surface means" and substitute therefor --surfaces--; and Column 13, lines 65 and 66, delete "means comprise insert means comprise".

Signed and Sealed this

*Twenty-fourth* Day of *December 1985*

[SEAL]

*Attest:*

*Attesting Officer*

DONALD J. QUIGG

*Commissioner of Patents and Trademarks*